US005083330A

United States Patent [19]

Dusar

[11] Patent Number: 5,083,330

[45] Date of Patent: Jan. 28, 1992

[54] ARRANGEMENT FOR SUPPORTING A SHOWER CURTAIN

[76] Inventor: Heinz Dusar, Kümmelbergweg 19, D-5450 Neuwied, Fed. Rep. of Germany

[21] Appl. No.: 577,894

[22] Filed: Sep. 5, 1990

[30] Foreign Application Priority Data

Sep. 5, 1989 [DE] Fed. Rep. of Germany ..... 3929380
Dec. 19, 1989 [DE] Fed. Rep. of Germany ..... 3941883

[51] Int. Cl.[5] ..... A47K 3/23; A47H 23/01

[52] U.S. Cl. ..... 4/608; 4/610; 4/558; 160/DIG. 6; 160/349.1

[58] Field of Search ..... 4/557, 558, 607, 608, 4/610, 612, 613, 614; 160/330, 349.1, 349.2, DIG. 6

[56] References Cited

U.S. PATENT DOCUMENTS

| | | | |
|---|---|---|---|
| 1,691,339 | 11/1928 | Deming | 160/349.1 |
| 2,712,354 | 7/1955 | Margolies | 160/330 |
| 2,761,150 | 9/1956 | Kellogg | 4/558 |
| 3,025,532 | 3/1962 | Skuda | 4/608 |
| 3,879,806 | 4/1975 | Armstrong | 4/608 |
| 4,594,741 | 6/1986 | Payne | 4/608 |
| 4,606,081 | 8/1986 | Baus | 4/557 |
| 4,759,087 | 7/1988 | Zeilinger | 4/558 |
| 4,887,324 | 12/1989 | Cairns | 160/349.2 |
| 4,888,835 | 12/1989 | Baumann | 4/607 |
| 4,916,764 | 4/1990 | Meaden et al. | 4/558 |

FOREIGN PATENT DOCUMENTS

| | | | |
|---|---|---|---|
| 2907890 | 9/1980 | Fed. Rep. of Germany | 4/610 |
| 3237291 | 4/1984 | Fed. Rep. of Germany | 4/614 |
| 3417044 | 11/1985 | Fed. Rep. of Germany | 4/610 |
| 3507264 | 2/1986 | Fed. Rep. of Germany | 4/612 |
| 2182085 | 5/1987 | United Kingdom | 4/610 |

*Primary Examiner*—William A. Cuchlinski, Jr.
*Assistant Examiner*—John L. Beres
*Attorney, Agent, or Firm*—Robert W. Becker & Associates

[57] ABSTRACT

A shower curtain support arrangement for separating a water receptacle such as a shower basin or a bathtub from its surroundings, the shower curtain being supported and guided on an upper rail above the receptacle, one longitudinal edge of the curtain being connected to a wall-connecting profile which is to be secured to a wall and the other longitudinal edge of the curtain being connected to a grip strip which is guided both in the upper rail and also by means of a magnetic guide on the rim of the receptacle, the grip strip having connection elements for the purposes of connection to a grip strip of an adjacent curtain or to an assigned wall-connecting profile. Improved sealing of the receptacle with respect to the rest of the room and also a comparatively taut curtain guidance can be achieved.

12 Claims, 2 Drawing Sheets

ARRANGEMENT FOR SUPPORTING A SHOWER CURTAIN

BACKGROUND OF THE INVENTION

1. Field of the Invention

The invention relates to an arrangement for supporting a shower curtain serving to separate a shower tray or basin, or at least part of a bathtub, from its surroundings, the shower curtain being supported and guided on a rail which is arranged over the shower tray or bathtub.

2. Description of the Prior Art

Shower curtains are used to separate not only an open shower tray, but also at least part of a bathtub from its surroundings in, for example, a bathroom or even a living room, the shower curtain being held by hangers on a rod arranged over the rim of the shower tray or bathtub. Closure of the shower curtain with respect to the shower tray or bathtub and the room walls is then in most cases achieved by an excess in the curtain measurements determining that the curtain reaches close to the base of the tray or tub and also greatly overlaps an adjacent curtain piece or a wall. A resulting disadvantage is that the curtain, particularly due to its large-scale proportions, is drawn by suction action developing during showering in the separated shower cubicle defined by the curtain towards the body of the person showering. Apart from the resulting constriction of freedom of movement of the person showering, the curtain material is also lifted from the tray or tub and/or away from the wall or the further overlapping curtain piece so that the desired sealing of the shower cubicle is at least impaired. A further disadvantage is that as a result of the fold formation in the shower curtain, mold formation is encouraged so that insufficient hygiene can be established in this area.

The underlying object of the invention therefore lies in making available an arrangement for supporting a shower curtain, which arrangement effects improved sealing of the water receptacle, for example the shower tray or the bathtub, with respect to the rest of the room and even effects comparatively taut curtain guidance.

SUMMARY OF THE INVENTION

According to the present invention there is provided a shower curtain support arrangement for separating a water receptacle as a shower basin from its surroundings, the shower curtain being supported and guided on an upper rail above the receptacle with one longitudinal edge of the curtain connected to a wall-connecting profile which is to be secured to a wall and the other longitudinal edge of the curtain being connected to a grip strip which is guided both in the upper rail and also by means of a magnetic guide on the rim of the receptacle, the grip strip having connection means for connecting to a grip strip of an adjacent curtain or to an assigned wall-connecting profile. In this arrangement the curtain is held and secured on its two edges so that the curtain is not able to execute any movements towards the interior of the receptacle. At the same time the means of securing the curtain to the wall-connecting profile to be provided on the wall, on the one hand, and to the grip strip which cooperates with a counterpart, on the other hand, establish good sealing of the curtain portions, because the curtain cannot be detached from these components and the components themselves occupy a fixed position. As a result of the guidance of the grip strip both in the upper rail and on the rim of the receptacle, good clamping of the curtain results, without fluttering of the curtain in use.

If the receptacle is a corner shower, or a shower with just one open side, or either of these arrangements are to be provided with a bathtub, the grip strip can cooperate with another grip strip or with a wall-connecting profile provided on the other side of the room in a corresponding manner.

A further advantage is that the components pertaining to the support arrangement can easily by assembled with no need for changes to be made to the room in which the arrangement is to be used. This means that the arrangement can also be removed again easily and without lasting damage. As a result, it is also possible for users of rented accommodation to install the support arrangement in a simple manner.

In a preferred exemplary embodiment for achieving improved guidance of the grip strip there is provided on the upper rim of the water receptacle at the lower end of the grip strip, an angle or bracket which embraces the receptacle rim and which preferably projects outwards from the grip strip and slides with its perpendicular leg on the outside of the receptacle rim. It can, however, also be advantageous to arrange this angle so that it projects inside the receptacle and effects guidance there.

With water receptacles of which their basic construction predominantly consist of a metallic material, it is particularly advantageous to arrange a magnet at the angle for the purpose of guiding the grip strip on the receptacle rim. This magnet fixes the grip strip in relation to the receptacle and avoids, or helps to avoid, outward swinging away of the curtain. In the case of a movement of the grip strip, the magnet thus slides along the receptacle rim and ensures that there is reliable guidance of the grip strip in relation to the receptacle, without a fixed guide arrangement being provided for this.

As for a sliding surface, the magnet is provided with a coating of an advantageous material, preferably of plastics material. In this connection, it is particularly advantageous to form the angle itself out of plastic material and to incorporate the magnet in the assigned angle leg.

The magnet itself is preferably arranged on the inside of the angle leg sliding on the outside of the receptacle rim. It is also possible, however, to provide that the magnet be arranged in the angle leg resting on the upper receptacle rim and to guarantee here support of the grip strip in relation to the receptacle rim.

For water receptacles not made of a metallic material a metallic strip is provided, preferably glued, on the upper rim of the receptacle so that the magnet guided on the upper rim of the receptacle adheres to the receptacle by way of the metallic strip.

A preferred exemplary embodiment provides that the respective connection between wall-connecting profile, grip strip and curtain be formed as a clamping connection. The resultant particular advantage of this is that, once the arrangement is assembled, the curtain material can be exchanged without great expense so that the users can follow today's rapidly changing design trends without great installation expense with regard to the support arrangement.

The formation of the clamping connection between curtain and grip strip or wall-connecting profile respectively can be effected such that, after the curtain material has been inserted into the clamping connection, when the latter is closed no additional tension is applied to the curtain. In this way, in assembly, suitable pre-tension can be imparted to the curtain, which pre-tension does not change when the clamping connection is closed.

According to one exemplary embodiment, the connection elements for the purposes of connection of the curtain grip strip to another grip strip or to a wall-connecting profile respectively are formed as a magnetic strip. However, other kinds of form-closing or force-closing connections can also be provided, which connections are tight in the case of mutual installation but nevertheless can easily be undone.

In so far as a corner receptacle is to be provided with the support arrangement each of the two curtain portions, which are to be provided on the open sides of the corner receptacle, is connected respectively to a wall-connecting profile and to a grip strip, there being provided on the free corner of the receptacle on its upper rim a receiving portion into which the grip strips of the curtains can be pushed. In this way, form-closing guidance of the grip strips to be joined together is ensured in the corner area so that even in this area there is a good seal. In this regard, it is advantageous if the receiving portion has two funnel-shaped openings which run in the direction of the respective parts of the receptacle rim and into which the grip strips can be pushed until closing so that mutual installation is achieved. To this purpose one exemplary embodiment provides that one or both openings of the receiving portion be provided with a locking arrangement, by means of which the grip strip which is pushed into the openings can be fixed. Advantages are on the other hand of being able to fix the one curtain portion constantly in the case of a corner shower so that only one side is used as an entrance with a movable curtain guide. A further advantage lies in locking the grip strip with the receiving portion when assembling the arrangement in order to give, starting from this fixed position of the grip strip, the necessary pre-tension to the curtain with regard to the clamping in the wall-connecting profile.

Both the tightness of the curtain and the guidance of the grip strip can be improved by applying to the upper receptacle rim a rail in which the lower end of the grip strip is guided. In this regard the rail can also be formed so that the curtain material itself is laid into a fold of the rail.

Particular advantages arise if the portions of the arrangement to be provided on the walls and the receptacle portions respectively, such as wall-connecting profile, receiving portion and guide rail, can each be glued thereon so that they can be assembled easily and removed again without lasting damage.

BRIEF DESCRIPTION OF THE DRAWINGS

For a better understanding of the invention and to show how the same may be carried into effect, reference will be made, by way of example, to the accompanying drawings, in which.

DESCRIPTION OF THE PREFERRED EMBODIMENTS

Figure 1:
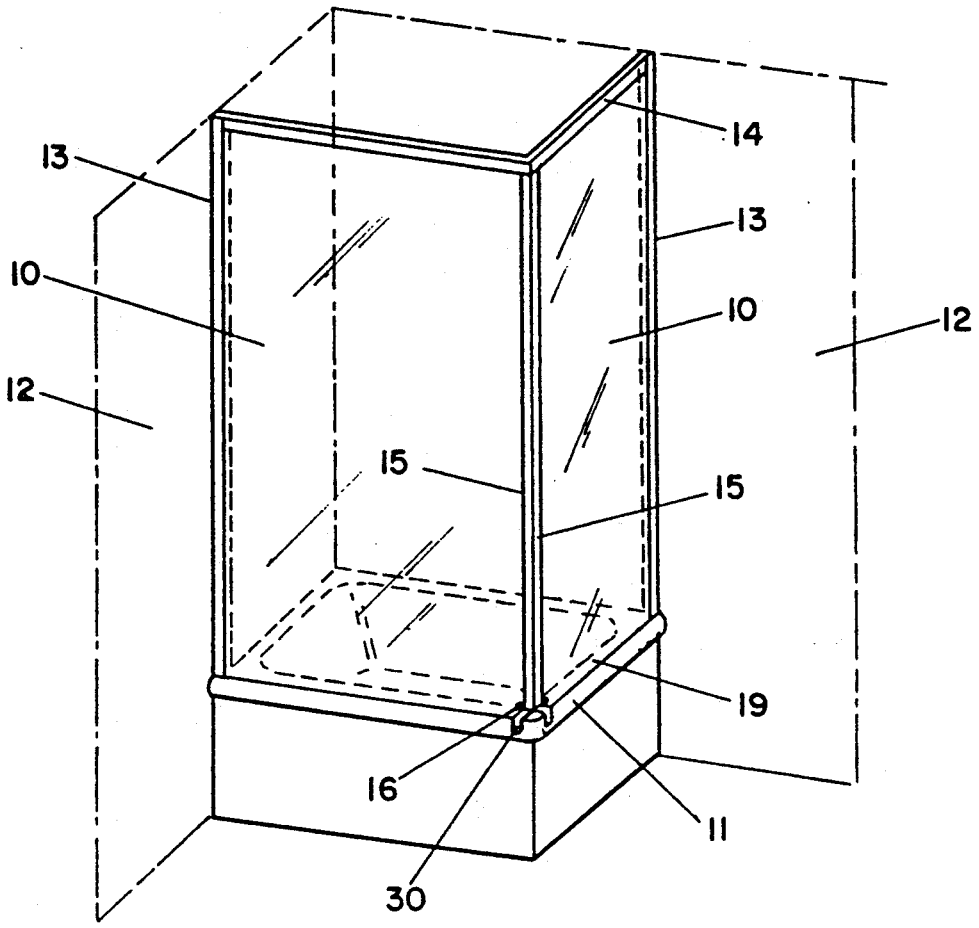
FIG. 1 is a diagrammatic perspective view of a shower tray with a shower curtain.

Referring to FIG. 1, the shower tray 11, which is to be separated from its surroundings by the curtain 10, is in the form shown for a corner shower with two open sides so that there are provided on the two adjacent room walls 12 two wall-connecting profiles 13 for the purpose of supporting two curtain portions 10. Provided over the tray 11, following the rim of the tray as regards its shaping, is a rail 14 which is connected with the walls 12 and in which there is respectively guided a grip strip 15 provided at each free end of each curtain portion 10. The grip strips 15 of the two curtain portions 10 meet in the corner area of the shower tray 11.

Figure 2:
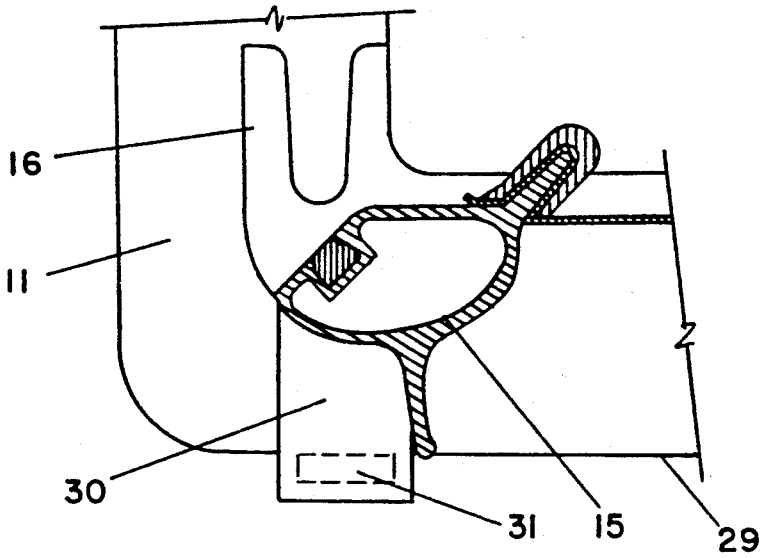
FIG. 2 is a sectional view on a larger scale of a grip strip at the water receptacle rim.

Turning to FIG. 2, there is provided at the lower end of each grip strip 15 an angle or bracket 30 which outwardly overlaps the tray rim 29 of the shower basin 11 and consists of one angle leg sliding on the upper surface of the tray rim 29 and of one angle leg sliding on the outside of the tray rim. In the exemplary embodiment shown, there is arranged on the angle leg of the angle 30 sliding on the outside of the tray rim a magnet 31 which ensures that there is a force-locking connection between the grip strip 15 and the tray rim 29 of the shower tray 11.

Figure 5:
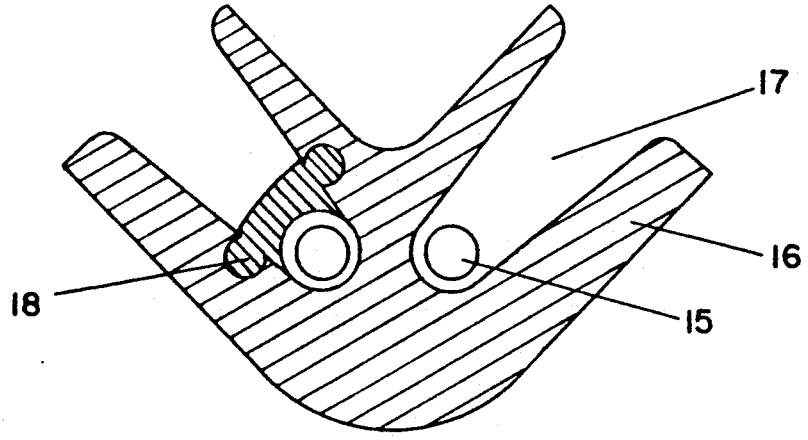
FIG. 5 is a plan view on a larger scale of a receiving portion.

For the purposes of supporting the grip strip 15 in the corner area there is applied to the tray rim in this area a receiving portion 16 which can be seen best in FIG. 5. The receiving portion 16 has openings 17 which widen outwards in a funnel-shaped manner for the purpose of receiving the grip strips 15, the spacing of the deepest parts of the two openings 17 in relation to each other being dimensioned so that the outer edges of the grip strips 15 introduced therein butt against each other. The receiving portion 16 has a locking arrangement 18 by means of which the inserted grip strips 15 can be fixed in the receiving portion 16. For the purposes of improved guidance of the grip strips 15 on the tray rim there is provided a rail 19 which can preferably be glued on the tray rim.

Figure 3:
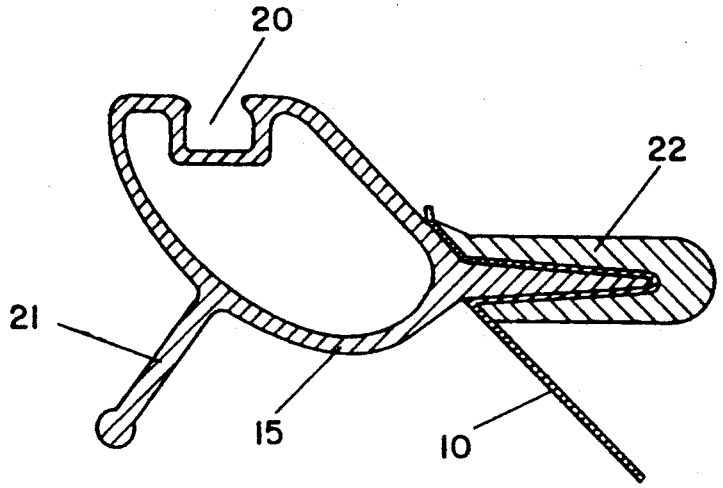
FIG. 3 is a sectional view also on a larger scale of another grip strip.

The grip strip 15 shown in FIG. 3 has a magnetic strip 20 as connection element in relation to a further grip strip of an adjacent curtain or in relation to an assigned wall-connecting profile which is fitted with a corresponding counterpart. Futhermore, the grip strip 15 has a handle 21 for controlling the grip strip during displacement thereof, as well as a clamping portion 22 for clamping support of the assigned curtain portion 10.

Figure 4:
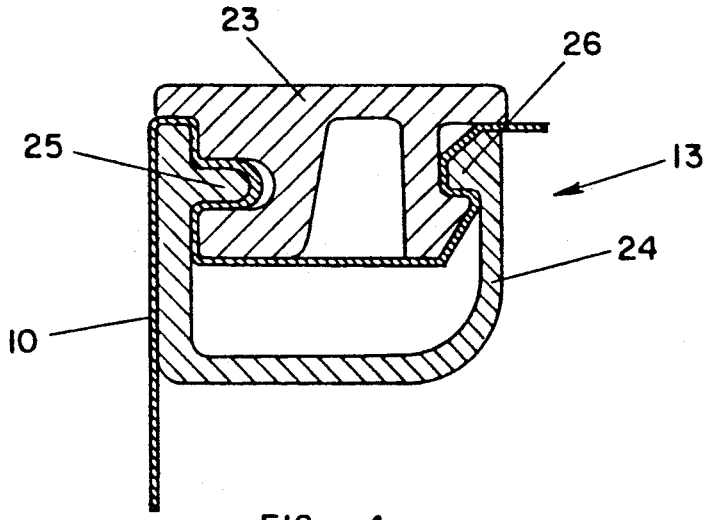
FIG. 4 is a sectional view on a larger scale of a wall-connecting profile.

The wall-connecting profile shown in FIG. 4 has a fixed clamping portion 23 and a movable clamping portion 24 between which the curtain 10 can be laid. The fixed clamping portion 23 is then preferably glued to a wall. The two portions 23, 24 of the clamping connection forming the wall-connecting profile 13 are connected with each other, on the one hand, by means of a hinge 25 formed by a projection on the portion 24 which engages into a recess in the fixed portion 23, and, on the other hand, by means of a closure 26 which is developed as a snap-connection. In this case, the hinge 25 is arranged on the feed side of the curtain 10 in relation to the wall-connecting profile 13 so that by inserting the curtain into the clamping connection 23, 24 and fixing, in the first instance, the hinge 25, a position of the curtain 10 is preset, which position is not changed any more when the closure 26 is closed. It is thereby guaranteed that when the arrangement is assembled, the curtain is laid between the movable clamping portions 23, 24 with a certain pre-tension and is fixed in the pre-tensioned position as a result of the fixation by means of the hinge 25, and that the subsequent closure of the snap-connection 26 then exerts no further tension on the curtain, because the closure of the snap connection 26 can only affect the curtain until such time as it is fixed in the hinge 25.

The present invention is, of course, in no way restricted to the specific disclosure of the specification and drawings, but also encompasses any modifications within the scope of the appended claims.

What I claim is:

1. In an arrangement for supporting shower curtain portions for separating, from its surroundings, a water receptacle that has a rim and is in the form of a shower basin or a bathtub, with said shower curtain portions being supported and guided on an overhead rail that is disposed above said water receptacle, the improvement wherein:

each of said shower curtain portions has two longitudinal, essentially vertical edges, one of which is connected to a wall-connecting profile that is to be secured to a wall, and the other of which is connected to a grip strip that is guided not only in said overhead rail but also, via magnetic guide means, on said rim of said water receptacle, with said grip strip being provided with connection means for selective connection thereof to a grip strip of an adjacent shower curtain portion or to an associated wall-connecting profile, and wherein said magnetic guide means comprises: an angle bracket that is disposed at a lower end of said grip strip and engages said rim of said water receptacle, and a magnet that is disposed at a surface of said bracket that rests on said rim.

2. An arrangement according to claim 1, in which said magnet is provided with a coating to form a sliding surface.

3. An arrangement according to claim 2, in which said angle bracket is made of plastic and has legs, with said magnet being incorporated in one of said legs.

4. An arrangement according to claim 1, in which a metallic guide strip is disposed on said rim of said water receptacle.

5. An arrangement according to claim 1, in which a further rail is disposed on said rim of said water receptacle, with said grip strip being guided in said further rail in a form-closing manner.

6. An arrangement according to claim 1, which includes clamping means to effect the respective connection between said wall-connecting profile, grip strip, and shower curtain portion.

7. An arrangement according to claim 1, in which said connection means of said grip strip is in the form of a magnetic strip.

8. In an arrangement for supporting shower curtain portions for separating, from its surroundings, a water receptacle that has a rim and is in the form of a shower basin or a bathtub, with said shower curtain portions being supported and guided on an overhead rail that is disposed above said water receptacle, the improvement wherein:

each of said shower curtain portions has two longitudinal, essentially vertical edges, one of which is connected to a wall-connecting profile that is to be secured to a wall, and the other of which is connected to a grip strip that is guided not only in said overhead rail but also, via magnetic guide means, on said rim of said water receptacle, with said grip strip being provided with connection means for selective connection thereof to a grip strip of an adjacent shower curtain portion or to an associated wall-connecting profile, wherein said water receptacle is disposed in a corner and is open on two sides, with a shower curtain portion being provided for each of said open sides, with one of said longitudinal edges of each of said shower curtain portions being connected to a wall-connecting profile while the other of said longitudinal edges thereof is connected to a grip strip, with the free corner of said wall receptacle, where said open sides come together, being provided on said rim of said receptacle with a receiving member into which can be inserted said grip strips, wherein said receiving member is provided with two funnel-shaped openings that extend in the direction of the pertaining portion of said receptacle rim, with said openings having such a depth that said grip strips are received to such an extent therein that they closingly rest against one another.

9. An arrangement according to claim 8, in which said receiving member is provided with locking means to lock at least one of said grip strip therein.

10. An arrangement according to claim 8, in which parts of said arrangement that are to be secured to said water receptacle or to a wall are adapted to be glued thereto.

11. An arrangement according to claim 8, in which, to effect said connection between said wall-connecting profile and said shower curtain portion, said wall-connecting profile is provided with a clamping connection in the form of a movable clamping portion and a fixed clamping portion that are embodied in such a way that upon closure of said clamping connection to hold said shower curtain portion therebetween, no tension is applied to said shower curtain portion in the direction of a closing movement.

12. An arrangement according to claim 11, in which, to effect engagement of said movable clamping portion with said fixed clamping portion, said clamping connection includes a hinge means and a closure, with said hinge means being disposed on a feed side of said shower curtain portion relative to said wall-connecting profile.

* * * * *